US006196123B1

(12) United States Patent
Sofy

(10) Patent No.: US 6,196,123 B1
(45) Date of Patent: Mar. 6, 2001

(54) PRESS TRANSFER-ELECTRICAL INTERCONNECT

(75) Inventor: Hugh Sofy, Troy, MI (US)

(73) Assignee: HMS Products Co., Troy, MI (US)

( * ) Notice: Subject to any disclaimer, the term of this patent is extended or adjusted under 35 U.S.C. 154(b) by 0 days.

(21) Appl. No.: 09/491,190

(22) Filed: Jan. 25, 2000

(51) Int. Cl.[7] ..... B30B 15/30

(52) U.S. Cl. ..... 100/45; 100/49; 100/207; 72/405.01

(58) Field of Search ..... 100/207, 45, 49; 72/405.01, 405.11, 405.12, 16.2, 16.4, 18.2; 439/949, 192, 194, 195, 213

(56) References Cited

U.S. PATENT DOCUMENTS

| | | | | |
|---|---|---|---|---|
| 4,833,908 | * | 5/1989 | Sofy | 72/405 |
| 5,074,141 | * | 12/1991 | Takeuchi | 72/405 |
| 5,327,768 | * | 7/1994 | Yamashita | 72/405 |
| 5,363,685 | * | 11/1994 | Luthi et al. | 72/405 |
| 6,000,327 | * | 12/1999 | Moriyasu et al. | 100/207 |

* cited by examiner

*Primary Examiner*—Peter Vo
*Assistant Examiner*—Louis Huynh

(74) *Attorney, Agent, or Firm*—Howard & Howard

(57) ABSTRACT

A transfer assembly for moving work pieces through a press which includes a hollow transfer bar (12) and a motion transmitting mechanism (20) moves the transfer bar (12) inward, outward, and longitudinally for transferring work pieces through the press. A finger (22) is attached to the transfer bar (12) for engaging and transferring work pieces through the press. A proximity sensor (24) is disposed on the finger (22) for sensing the presence of a work piece. In order to establish electrical connection with the sensor (24), an electrical lead is disposed within the hollow transfer bar (12) for connection to the sensor (24). An inline connector (30) electrically interconnects sections (26 and 28) of the electrical lead within the hollow transfer bar (12) to allow the sections (26 and 28) to be removed from the hollow transfer bar (12) and disconnected for movement independently from one another. A junction box (48, 148 or 248) is attached to a support plate (40) and presents an electrical junction (50, 150 or 250) for attachment to an electrical cable (52). A multiple lead conduit (54) electrically interconnects the block (36) and the junction box (48, 148 or 248). In all three embodiments, the multiple lead conduit (54) extends from the block (36) in a direction parallel to the transfer bar (12) and extends through a U-turn (56) inside the support plate (40) to the junction box (48, 148 or 248).

19 Claims, 4 Drawing Sheets

PRESS TRANSFER-ELECTRICAL INTERCONNECT

BACKGROUND OF THE INVENTION

1. Field of the Invention

The subject invention relates to work piece transfer assembly for a press including a reciprocating member and a series of longitudinally spaced in-line stations wherein each station is a further progression of a work piece forming process. More specifically, the invention relates to the electrical lead combination for establishing an electrical connection with a sensor on work piece engaging fingers extending from a transfer bar.

2. Description of the Prior Art

As alluded to above and as is well known in the art, such assemblies include a hollow transfer bar having walls and a motion transmitting mechanism for moving the bar inward, outward, and longitudinally for transferring work pieces through the press. A plurality of fingers are attached to the transfer bar for engaging and transferring work pieces through the press and a sensor is disposed on the finger for sensing a work piece. In order to transmit electrical signals to and from the sensor, an electrical lead is disposed within the hollow transfer bar for connection to the sensor.

Typical prior art assemblies are disclosed in U.S. Pat. Nos. 4,833,908 to Sofy et al; U.S. Pat. Nos. 4,852,381 and 4,895,013, both to Sofy, the inventor herein, and U.S. Pat. No. 5,074,141 to Takeuchi.

In most prior systems, the electrical lead passes through the walls of the transfer bar but must be totally removed for maintenance. In addition, the connectors are supported by the transfer bar and are exposed to damage.

SUMMARY OF THE INVENTION AND ADVANTAGES

The subject invention provides a work piece transfer assembly for a press including a reciprocating member and a series of longitudinally spaced in-line stations wherein each station is a further progression of a work piece forming process. More specifically, the assembly comprises a hollow transfer bar having walls and a motion transmitting mechanism for moving the transfer bar inward, outward, and longitudinally for transferring work pieces through the press. A finger is attached to the transfer bar for engaging and transferring work pieces through the press and a sensor is disposed on the finger for sensing a work piece. An electrical lead is disposed within said hollow transfer bar for connection to the sensor. The assembly is characterized by a input section of the electrical lead extending into the hollow transfer bar and an second cable section of the electrical lead extending from within the hollow transfer bar to the exterior thereof and an inline connector electrically interconnecting the sections within the hollow transfer bar for disconnecting the sections from one another to allow the sections to be removed from the hollow transfer bar independently from one another.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
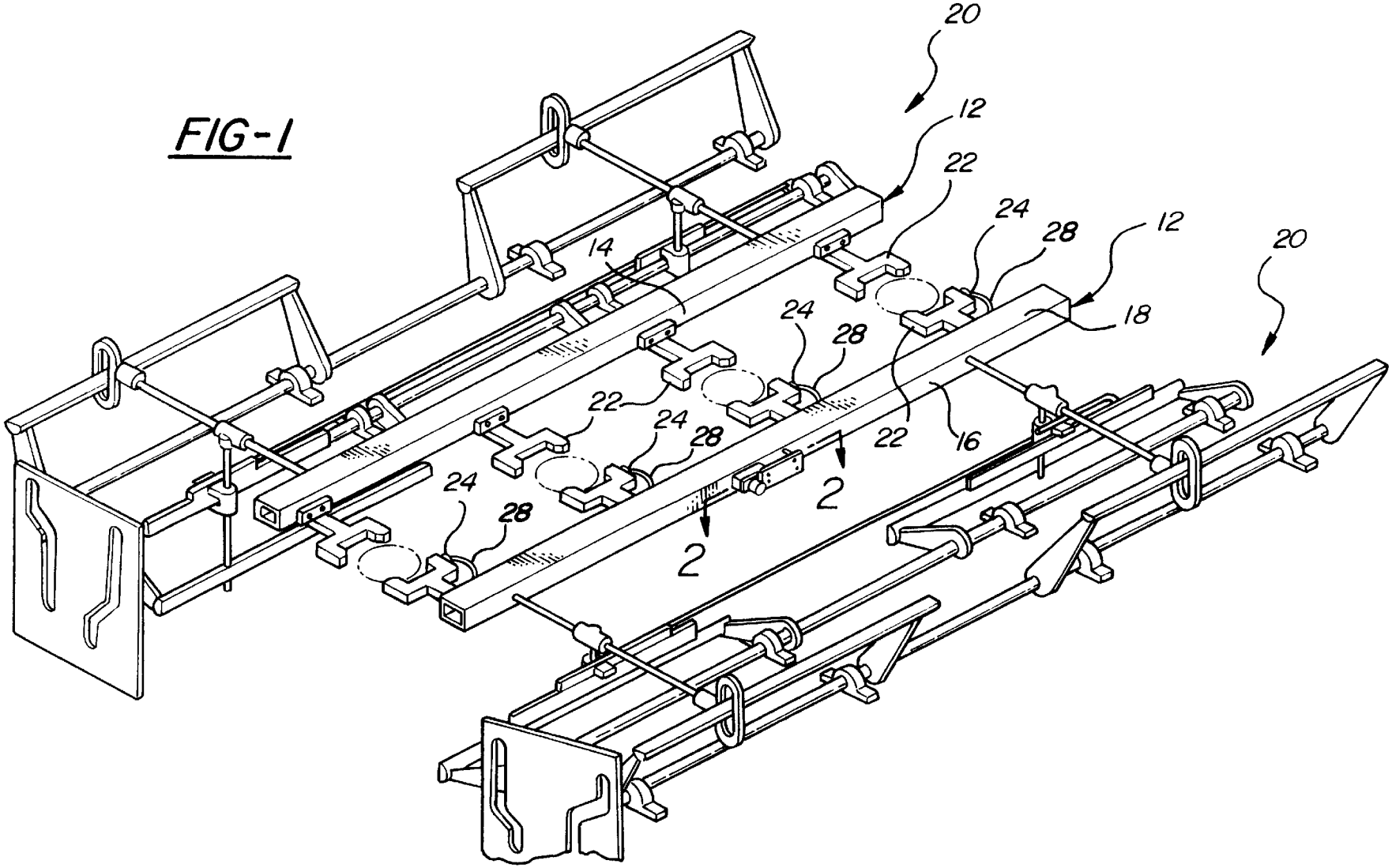
FIG. 1 is a perspective view of a press transfer incorporating the subject invention.

Referring to the Figures, wherein like numerals indicate like or corresponding parts throughout the several views, a work piece transfer assembly for a press including a reciprocating member and a series of longitudinally spaced in-line stations wherein each station is a further progression of a work piece forming process is shown in FIG. 1. The transfer assembly is specifically adapted for operation with a press of the type including a reciprocating member, i.e., a ram, and a series of in-line die stations wherein each station is a further progression of the work piece forming process. The transfer assembly includes a hollow transfer bar, generally indicated at 12, having a front wall 14 and a back wall 16 interconnected by top and bottom walls 18. A motion transmitting mechanism, generally shown at 20, moves the transfer bar 12 inward, outward, and longitudinally for transferring work pieces through the press. The transfer mechanism may be of the type well known in the art as described in any one of the aforementioned Sofy patents.

A finger 22 is attached to the transfer bar 12 for engaging and transferring work pieces through the press. A proximity sensor 24 is disposed on the finger 22 for sensing the presence of a work piece. In order to establish electrical connection with the sensor 24, an electrical lead is disposed within the hollow transfer bar 12 for connection to the sensor 24.

More specifically, the assembly is characterized by a first cable section 26 of the electrical lead extending into the hollow transfer bar 12 and a second cable section 28 of the electrical lead extending from within the hollow transfer bar 12 to the exterior thereof. An inline connector 30 electrically interconnects the sections 26 and 28 within the hollow transfer bar 12 for disconnecting the sections 26 and 28 from one another to allow the sections 26 and 28 to be removed from the hollow transfer bar 12 independently from one another. The inline connector 30 can take various forms by being threaded together or connected by a bayonet connection.

An inside connector 32 supports the leads in the first cable section 26 in the wall of the transfer bar 12 for receiving a clamping nut 33 on an electrical block 36, the electrical block 36 being electrically connected to a plurality of input connectors 32 for connection to a plurality of sensors 24. A first cable gland 34 supports the second cable section 28 in the wall of the transfer bar 12 for leading to a sensor 24. The first cable gland 34 is disposed in the front wall 14 of the transfer bar 12 and the inside connector 32 is disposed in the back wall 16. The first cable gland 34 may clamp the cable section 26 in the wall 14 but may be loosened to pull the first cable section 26 out of the transfer bar 12 which after the connector 30 disconnects the first section 26 from the second section 28.

Each inside connector 32 and is part of the electrical block 36. A support defined by a plate 40 supports the nut 33 on the transfer bar 12. The plate 40 is spaced from the back wall 16 of the transfer bar 12 by a plurality of fasteners interconnecting the plate 40 and the back wall 16 of the transfer bar 12 to hold the plate 40 in the spaced relationship to the transfer bar 12. The fasteners comprise bolts 42 and spacers 44 with the spacers 44 clamped between the back wall 16 of the transfer bar 12 and the plate 40 by the bolts 42. The inside connector 32 is disposed between the plate 40 and the back wall 16 of the transfer bar 12. The front wall 14 of the transfer bar 12 includes holes 46 aligned with the bolts 42 extending through the back wall 16 for providing access to the bolts 42 with a tool, e.g., an Allen wrench or screwdriver.

A junction box 48, 148 or 248 is attached to the support plate 40 and presents an electrical junction or connector block 50, 150 or 250 for attachment to an electrical cable 52. A multiple lead conduit, generally indicated at 54, electrically interconnects the block 36 and the junction box 48, 148 or 248. As alluded to above, a plurality of first cable sections or leads 26 extend into the back wall 16 and are connected to the block 36 for electrically interconnecting the plurality of the sensors 24 to the junction box 48, 148 or 248.

In all three embodiments, the multiple lead conduit 54 extends from the block 36 in a direction parallel to the transfer bar 12 and extends through a U-turn 56 to the junction box 48, 148 or 248.

Figure 2:
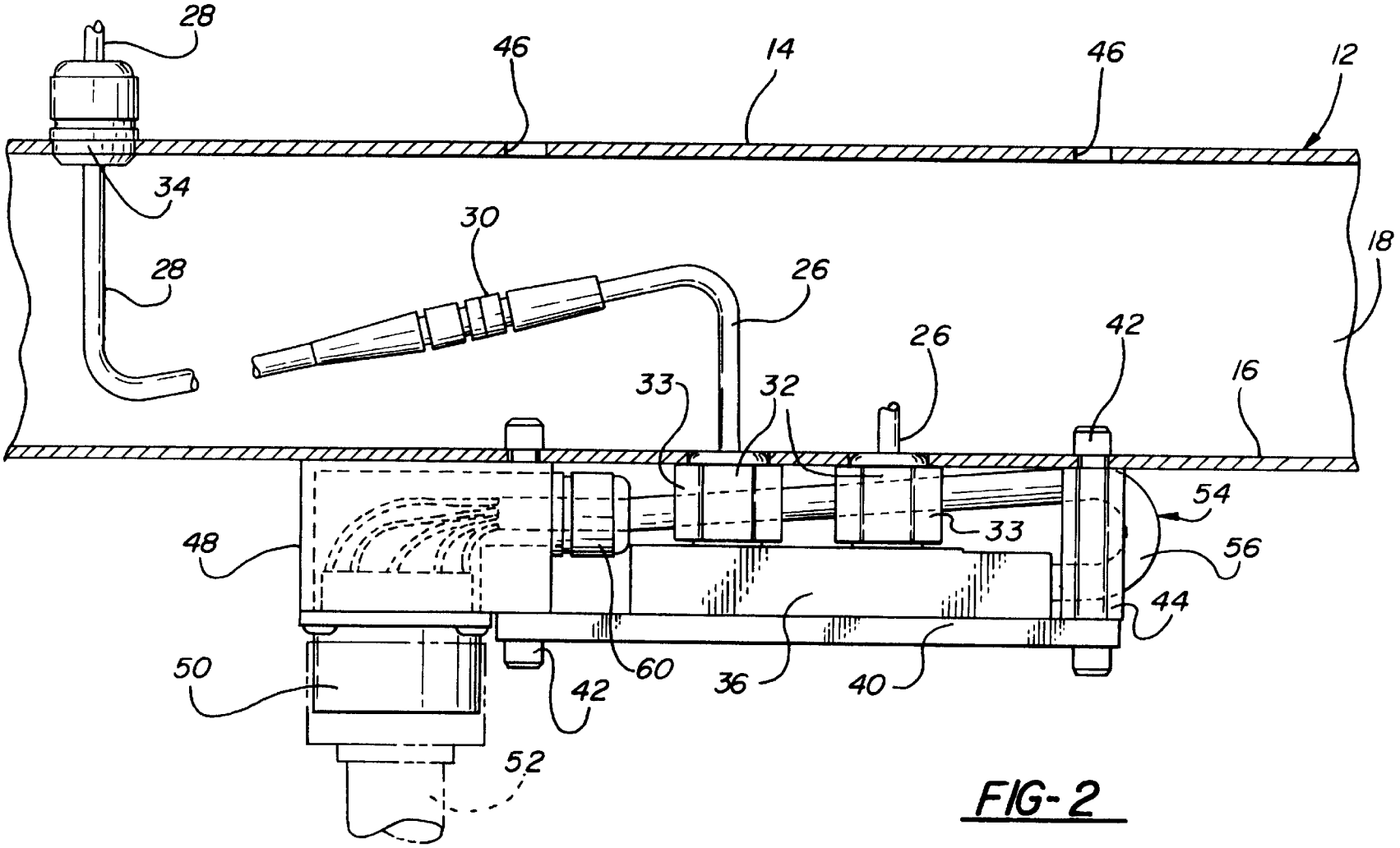
FIG. 2 is a fragmentary cross sectional view taken along line 2—2 of FIG. 1.
Figure 3:
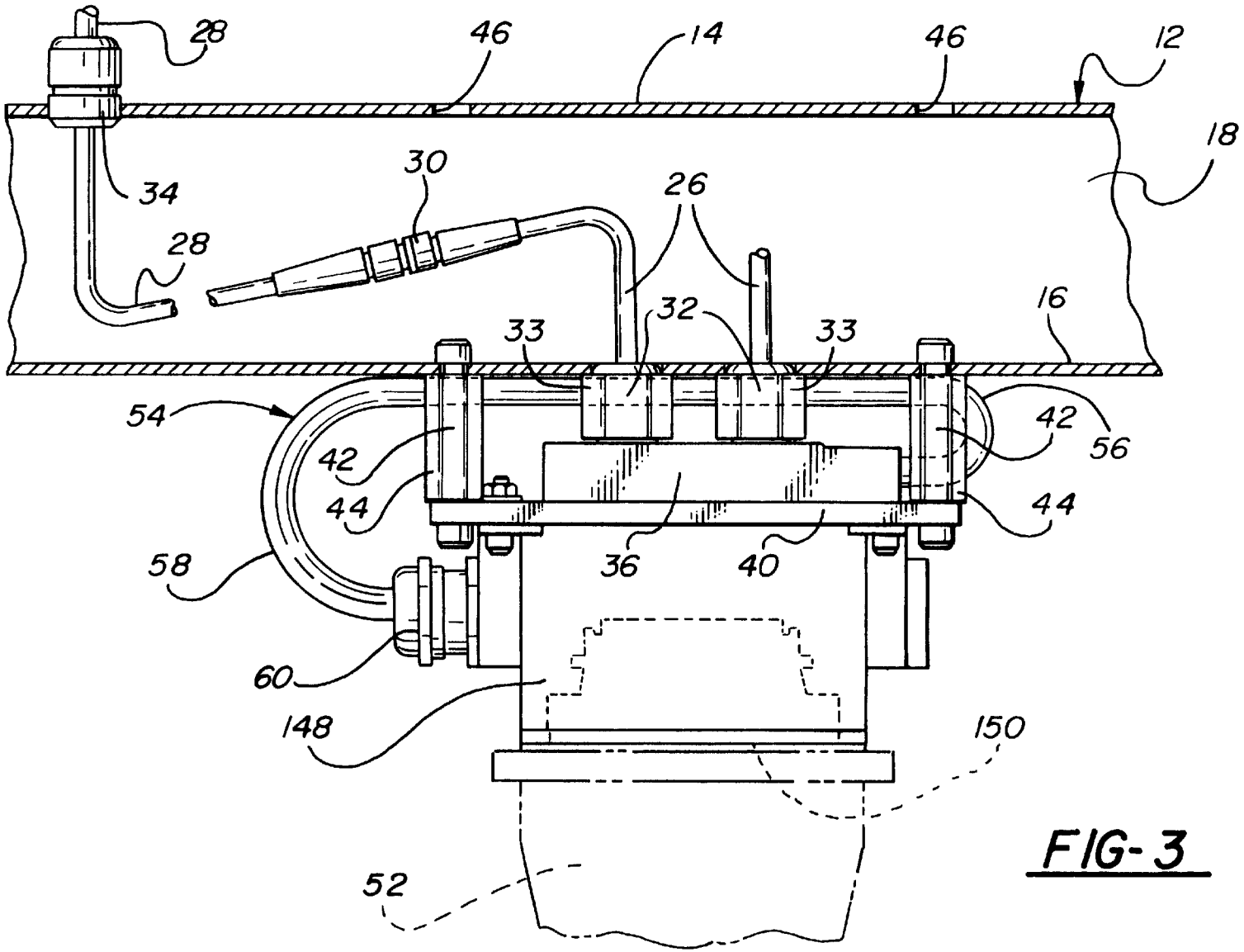
FIG. 3 is a fragmentary cross sectional view like FIG. 2 but showing a first alternative embodiment.

In the embodiments of FIGS. 2 and 3, the junction 50 or 150 faces outwardly from the plate 40, i.e., perpendicularly to the longitudinal extent of the transfer bar 12. Also, the multiple lead conduit 54 extends laterally into each junction box 48 or 148 i.e., into the side of the junction box 48 or 148. In addition, the multiple lead conduit 54 extends between the plate 40 and the back wall 16 of the transfer bar 12.

In the embodiment of FIG. 2, the junction box 48 is clamped between the plate 40 and the back wall 16 of the transfer bar 12 and extends laterally therefrom, i.e., from the side. The junction box 48 acts as a spacer for a bolt 42. The multiple lead conduit 54 extends laterally into the junction box 48 and the presents the electrical junction 50 outwardly of the plate 40.

On the other hand, in the embodiment of FIG. 3, the junction box 148 is supported outwardly of the plate 40 and the multiple lead conduit 54 extends through a second U-turn 58 and laterally into the junction box 148 on the outside of the plate 40.

Figure 4:
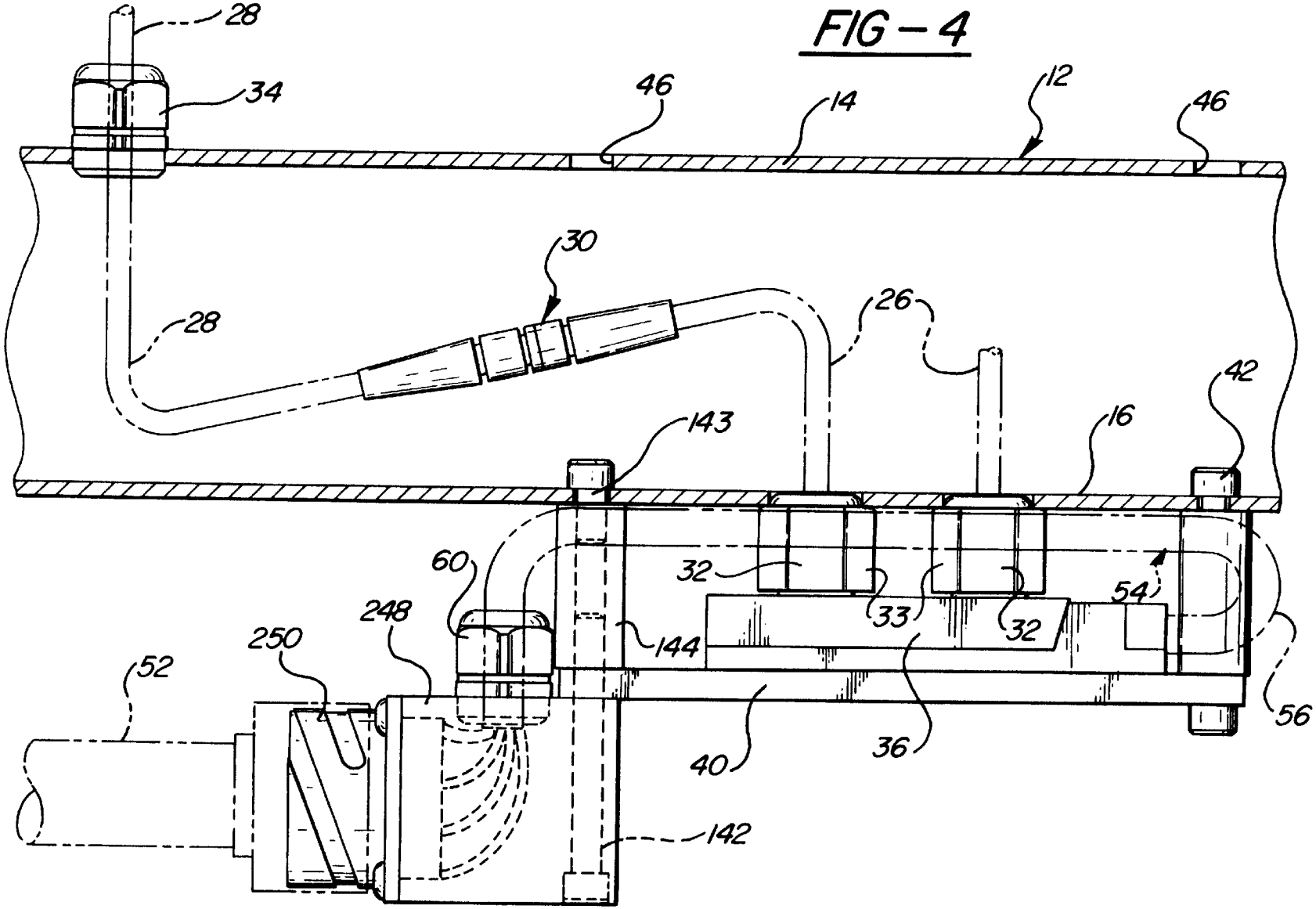
FIG. 4 is a fragmentary cross sectional view like FIG. 2 but showing a second alternative embodiment.

Still another variation is shown in FIG. 4 wherein the junction box 248 is supported outwardly of the plate 40 and the multiple lead conduit 54 extends through a the U-turn 56 and inwardly of the plate 40 and perpendicularly into the junction box 248 on the adjacent the plate 40. In this embodiment, the spacer 144 is threaded at each end and a bolt 142 extends through the junction box 248 to threadedly engage the spacer 144 and another, shorter bolt 143, extends through the back wall 16 and threadedly engages the spacer 144.

In all three embodiments, a second cable gland 60 supports the multiple lead conduit 54 to the connector block or junction box 48, 148 or 248.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A work piece transfer assembly for a press including a reciprocating member and a series of longitudinally spaced in-line stations wherein each station is a further progression of a work piece forming process, said assembly comprising:

a hollow transfer bar (12) having walls;

a motion transmitting mechanism (20) for moving said transfer bar (12) inward, outward, and longitudinally for transferring work pieces through the press;

a finger (22) attached to said transfer bar (12) for engaging and transferring work pieces through the press;

a sensor (24) on said finger (22) for sensing a work piece; and an electrical lead disposed within said hollow transfer bar (12) for connection to said sensor (24) and including a first cable section (26) of said electrical lead extending into said hollow transfer bar (12) and a second cable section (28) of said electrical lead extending from within said hollow transfer bar (12) to the exterior thereof and an inline connector (30) electrically interconnecting said sections (26 and 28) within said hollow transfer bar (12) to allow said sections (26 and 28) to be removed from said hollow transfer bar (12) and disconnected for movement independently from one another.

2. An assembly as set forth in claim 1 including an inside connector (32) supporting said first cable section (26) in said wall of said transfer bar (12).

3. An assembly as set forth in claim 2 including an cable gland (34) supporting said second cable section (28) in said wall of said transfer bar (12).

4. An assembly as set forth in claim 3 wherein said transfer bar (12) is four sided with a front (14) and a back (16) wall, said first cable gland (34) being in said front wall (16) and said inside connector (32) being in said back wall (16).

5. An assembly as set forth in claim 4 including a junction box (48, 148 or 248) attached to said support and presenting an electrical junction (50, 150 or 250) for attachment to an electrical cable (52).

6. An assembly as set forth in claim 5 wherein said support includes a plate (40) spaced from said back wall (16) of said transfer bar (12), and a plurality of fasteners interconnecting said plate (40) and said back wall (16) of said transfer bar (12) to hold said plate (40) in said spaced relationship to said transfer bar (12).

7. An assembly as set forth in claim 6 wherein said inside connector (32) is disposed between said plate (40) and said back wall (16) of said transfer bar (12).

8. An assembly as set forth in claim 7 wherein said fasteners comprise bolts (42) and spacers (44) with said spacers (44) clamped between said back wall (16) of said transfer bar (12) and said plate (40) by said bolts (42).

9. An assembly as set forth in claim 8 wherein said front wall (14) of said transfer bar (12) includes holes (46) aligned with said bolts (42) extending through said back wall (16) for providing access to said bolts (42) with a tool.

10. An assembly as set forth in claim 9 including an electrical block (36) supported on said plate (40) and connected to said inside connector (32), a multiple lead conduit (54) electrically interconnecting said block (36) and said junction box (48, 148 or 248).

11. An assembly as set forth in claim 9 including a plurality of first cable sections (26) extending into said back wall (16) and connected to said block (36) for electrically interconnecting a plurality of said sensors (24) to said junction box (48, 148 or 248).

12. An assembly as set forth in claim 11 wherein said multiple lead conduit (54) extends from said block (36) in a direction parallel to said transfer bar (12) and extends through a U-turn (56) to said junction box (48, 148 or 248).

13. An assembly as set forth in claim 11 wherein said multiple lead conduit (54) extends perpendicularly into said junction box (248).

14. An assembly as set forth in claim 11 wherein said multiple lead conduit (54) extends laterally into said junction box (48, 148 or 248).

15. An assembly as set forth in claim 11 wherein said junction (50 or 150) faces outwardly from said plate (40).

16. An assembly as set forth in claim 11 wherein said multiple lead conduit (54) extends between said plate (40) and said back wall (16) of said transfer bar (12).

17. An assembly as set forth in claim 11 wherein said junction box (48) is clamped between said plate (40) and said back wall (16) of said transfer bar (12) and extends laterally therefrom, said multiple lead conduit (54) extending laterally into said junction box (48) and said junction box (48) presenting said electrical junction (50) outwardly of said plate (40).

18. An assembly as set forth in claim 11 wherein said junction box (148) is supported outwardly of said plate (40) and said multiple lead conduit (54) extends through a second U-turn (58 56) and laterally into said junction box (148) on the outside of said plate (40).

19. An assembly as set forth in claim 11 wherein said junction box (248) is supported outwardly of said plate (40) and said multiple lead conduit (54) extends through a said U-turn (56) and inwardly of said plate (40) and perpendicularly into said junction box (248) adjacent said plate (40).

* * * * *